US007281717B2

(12) United States Patent
Sacco et al.

(10) Patent No.: US 7,281,717 B2
(45) Date of Patent: Oct. 16, 2007

(54) BINDING ADJUSTMENT SYSTEM

(76) Inventors: Marc Sacco, P.O. Box 438 C.I. 32 Sunset Trail, New Fairfield, CT (US) 06812; Wade Leener, 115 Lansdowne, Westport, CT (US) 06860

( * ) Notice: Subject to any disclaimer, the term of this patent is extended or adjusted under 35 U.S.C. 154(b) by 163 days.

(21) Appl. No.: 10/768,340

(22) Filed: Jan. 30, 2004

(65) Prior Publication Data

US 2004/0207179 A1 Oct. 21, 2004

Related U.S. Application Data

(60) Provisional application No. 60/443,913, filed on Jan. 31, 2003.

(51) Int. Cl.
*A63C 9/00* (2006.01)

(52) U.S. Cl. ..... 280/14.22; 280/14.24; 280/607; 280/634

(58) Field of Classification Search ..... 280/14.21–22, 280/14.24, 620, 607, 618, 633, 634
See application file for complete search history.

(56) References Cited

U.S. PATENT DOCUMENTS

| | | | | | |
|---|---|---|---|---|---|
| 5,354,088 | A | | 10/1994 | Vetter et al. | 280/618 |
| 5,499,837 | A | * | 3/1996 | Hale et al. | 280/607 |
| 5,553,883 | A | | 9/1996 | Erb | 280/607 |
| 5,762,358 | A | * | 6/1998 | Hale | 280/607 |
| 5,782,476 | A | | 7/1998 | Fardie | 280/14.2 |
| 5,791,678 | A | | 8/1998 | Perlman | 280/618 |
| 5,803,481 | A | * | 9/1998 | Eaton et al. | 280/633 |
| 5,820,139 | A | | 10/1998 | Grindl | 280/14.2 |
| 5,826,910 | A | | 10/1998 | Ricks et al. | 280/618 |
| 5,868,416 | A | | 2/1999 | Fardie | 280/607 |
| 5,876,045 | A | * | 3/1999 | Acuna, Jr. | 280/14.24 |
| 5,913,530 | A | * | 6/1999 | Berger et al. | 280/607 |
| 5,947,488 | A | * | 9/1999 | Gorza et al. | 280/14.21 |
| 5,971,419 | A | | 10/1999 | Knapschafer | 280/607 |
| 6,062,584 | A | | 5/2000 | Sabol | 280/607 |
| 6,065,767 | A | * | 5/2000 | Girotto et al. | 280/607 |
| 6,155,578 | A | * | 12/2000 | Patterson | 280/14.24 |
| 6,196,569 | B1 | * | 3/2001 | Berger et al. | 280/607 |
| 6,234,494 | B1 | | 5/2001 | Gien | 280/14.24 |
| 6,318,749 | B1 | * | 11/2001 | Eglitis et al. | 280/607 |
| 6,575,489 | B1 | * | 6/2003 | White | 280/613 |
| 6,905,133 | B2 | * | 6/2005 | Lett | 280/618 |
| 6,994,370 | B2 | * | 2/2006 | Sabol | 280/618 |
| 2003/0230870 | A1 | * | 12/2003 | Sabol | 280/618 |
| 2004/0100069 | A1 | * | 5/2004 | Cumby | 280/618 |

* cited by examiner

*Primary Examiner*—Christopher P. Ellis
*Assistant Examiner*—Vaughn Coolman

(57) ABSTRACT

A snowboard binding interface assembly for connecting a snowboard binding to a snowboard, the snowboard binding interface assembly facilitating rotational movement of the snowboard binding relative to the snowboard and having a locking element attached to the snowboard leash where the locking element can be disengaged by the rider pulling on the leash such that the rider may then rotate his snowboard boot.

30 Claims, 13 Drawing Sheets

BINDING ADJUSTMENT SYSTEM

CROSS-REFERENCE

This application claims the benefit of the filing date of U.S. Provisional Patent Application Ser. No. 60/443,913 filed Jan. 31, 2003.

FIELD OF THE INVENTION

The invention relates to a snowboard binding interface, and more specifically the invention relates to a snowboard binding interface that facilitates rotational movement of the snowboard binding relative to the snowboard.

BACKGROUND OF THE INVENTION

Snowboarding has become a worldwide sport with millions of riders in the United States. Riders have invested large sums of money in purchasing state-of-the-art equipment, such as bindings and snowboards.

Typically, a snowboard assembly comprises a snowboard and a snowboard binding assembly for each foot that is attached to the top surface of the snowboard. A rider must wear snowboard boots that are specially adapted to interface with the snowboard binding assembly to hold the rider's feet to the snowboard. The snowboard itself is typically an elongated composite material that is semi-rigid which allows the rider to slide across the surface of the snow. Snowboard binding assemblies and snowboards can become quite expensive and many riders have already invested in snowboarding equipment.

However, one disadvantage to existing snowboard equipment is that the snowboard binding rigidly maintains the snowboard boot in place at a preferred setting, typically at or nearly perpendicular to the longitudinal axis of the snowboard with one snowboard boot placed in front of the other. Therefore, depending upon the rider's preference, the rider typically looks over either his right or left shoulder (depending upon whether their right or left snowboard boot is in front) when sliding forward. This is a disadvantage because while the snowboard bindings may have been adjusted to a preset angular setting, the rider may desire to adjust the snowboard binding to a different angular setting depending upon the terrain, riding style and the duration the rider has been snowboarding.

Riders that use non-rotatable snowboard bindings also have a difficult time sliding on a flat surface such as at the bottom of the hill. Snowboard riders are well known for the "pigeon toe" walk when moving around on a flat surface such as when getting on a chair lift. Typically, when a snowboard rider needs to move around on a flat surface, he will remove his back snowboard boot from the rear snowboard binding so that he can push himself along with his back foot. However, the front foot is rigidly held in place at or nearly perpendicular to the longitudinal axis of the snowboard thereby causing the "pigeon toe" walk with the front foot turned in at a precipitous angle to the direction of movement. This forcing of the snowboard boot and therefore the rider's foot inward puts a tremendous amount of stress on the rider's front knee, leg and hip. It is also very difficult for the rider to move around in such an awkward stance, especially when moving through crowds and getting on and off a chair lift.

Another problem faced by snowboard riders is toe and/or heel drag. Toe and/or heel drag is a problem typically encountered by larger individuals having relatively large feet. With typical snowboard bindings as previously discussed, the snowboard boot is typically held at or nearly perpendicular to the longitudinal axis of the snowboard. If the rider has large feet, the toe and/or heel of the snowboard boot may extend beyond the edge of the snowboard. Therefore, when the rider makes a front or rear turn the toes and/or heels of his snowboard boots may drag against the snow. This is highly undesirable because it slows the rider down, causes drag to one side of the snowboard thereby increasing the difficulty of balancing on the snowboard, or may even catch on the snow or ice causing the rider to pitch forward and fall.

A number of patents have sought to address this problem with limited success.

For instance, a number of U.S. patents have provided a rotatable snowboard binding that will allow the rider to adjust the rotational angle of his snowboard boots relative to the longitudinal axis of the snowboard. However, these rotatable snowboard bindings are replacements for the rider's existing snowboard bindings. Since snowboard bindings are relatively expensive, it is undesirable for a rider to have to replace his existing snowboard bindings in order to purchase rotatable ones.

U.S. Pat. No. 6,155,578 to Patterson ("the '578 patent"), discloses a snowboard binding interface system for use with various snowboard bindings. The interface system allows the snowboard rider to rotate his snowboard boot from an original preset orientation to a position approximately or more closely parallel to the snowboard's longitudinal axis or direction. While the '578 patent may help to eliminate the "pigeon toe" walk, a rider will not be able to adjust the snowboard binding to a different angular positions depending on the terrain and conditions. In fact, the '578 patent teaches away from the rider being able to adjust the snowboard binding to a plurality of settings for snowboard runs where it states that the device is "rotatable to the original locked position for accurately orienting the secured binding 12 to its initial preset orientation for snowboarding runs." (Col. 5, lines 34-6). In addition, while the '578 patent is an improvement for the "pigeon toe" walk, some riders may not want to turn their foot to an angle completely inline with the longitudinal axis of the snowboard such that the rider has greater lateral stability and balance when moving around on the flat surface. The '578 patent also does not solve the problem of toe and/or heel drag as previously discussed. Another problem with the '578 patent is that the locking mechanism is not easily accessed. In order to rotate the binding, the rider must bend down to the binding to pull out the two locking elements and begin rotating the binding while they are held in the disengaged position. This can be very difficult to do wearing gloves or mittens, and it may be difficult for the rider to bend down to that extent to reach the locking elements with all clothing and equipment being worn.

U.S. Pat. No. 6,062,584 to Sabol ("the '584 patent"), discloses a retrofit device adapted to convert existing non-rotatable snowboard bindings to rotatable snowboard bindings. However, while the '584 patent may be able to adapt some existing bindings, it is only usable with snowboard bindings that are center bolted having a cap plate. In other words, the existing snowboard binding itself becomes an integral part of the retrofit assembly with the bolts of the existing snowboard bindings holding the retrofit device together such that to remove the snowboard bindings the retrofit device must also be disassembled. However, if the existing binding does not exactly lineup with the retrofit assembly, it cannot be used. Therefore, while the '584 patent teaches retrofitting existing snowboard bindings, it is limited to only those snowboard binding assemblies that have a cap plate that may be directly bolted to base plate. In addition, the '584 patent utilizes roller bearings to provide rotational functionality, however roller bearings are highly undesirable to use because snow and ice have a tendency to freeze these so that they no longer function properly.

SUMMARY OF THE INVENTION

Therefore what is desired is a snowboard binding interface assembly that will convert an existing non-rotatable snowboard binding on an existing snowboard to a rotatable snowboard binding.

It is also desired to provide a snowboard binding interface assembly having a universal mounting such that any type of snowboard binding may be utilized with the snowboard binding interface assembly.

It is further desired to provide a snowboard binding interface assembly that is separate and distinct from the snowboard binding such that the snowboard binding may freely be changed without having to disassemble the snowboard binding interface assembly.

It is still further desired to provide a snowboard binding interface assembly that allows a snowboard rider to adjust the rotation of his snowboard boots relative to the longitudinal axis of the snowboard to one of a plurality of positions for a snowboard run.

It is yet further desired to provide a snowboard binding interface assembly that minimizes the "pigeon toe" walk such that a snowboard rider may adjust the rotation of his snowboard boot relative to the longitudinal axis of the snowboard to a position optimal for the rider and still have lateral balance.

It is still further desired to provide a snowboard binding interface assembly that provides ease of adjustment for the positioning of the snowboard rider's boots relative to the longitudinal axis of the snowboard.

It is yet further desired to provide a snowboard binding interface assembly that effectively eliminates the problems associated with toe and/or heel drag.

It is still further desired to provide a snowboard binding interface assembly that allows the rider to perform various adjustments to the rotational position of his snowboard boots relative to the longitudinal axis of the snowboard while the rider is in motion, for instance when sliding down the hill or in mid-air as a trick jump.

These and other objects are achieved by a snowboard binding assembly that allows the rider to adjust the rotational position of his snowboard boots to any one of a plurality of angular positions relative to the longitudinal axis of the snowboard. The invention may comprise, for instance in one advantageous embodiment, a rotating assembly that is inserted between the snowboard and the snowboard binding. The rotating assembly is mounted to the snowboard and the snowboard bindings are mounted to the rotating assembly. The rotating assembly may comprise a first portion rigidly coupled to the snowboard boot binding, and a second portion rigidly attached to the snowboard. The rider may disengage a locking mechanism to allow the first portion to rotate relative to the second portion such that the rider may choose any of the plurality of rotational positions desired. The first and second portions may comprise a plate or disk and a ring assembly such that the plate or disk may rotate relative to the ring. Advantageously, the assembly may, in one advantageous embodiment, comprise a ¾ inch lift, which will have a tendency to lift the snow board boot higher off the snow and minimize, for instance, toe and/or heel drag.

In one advantageous embodiment a snowboard binding interface assembly for mounting a snowboard binding to a snowboard the interface assembly is provided comprising, a base plate coupled to the snowboard and having a plurality of recesses for receiving a locking device, and a stationary annular retaining ring rigidly coupled to the base plate. The interface assembly further comprises, a binding plate captured by the stationary annular retaining ring, the binding plate rotationally displaceable with respect to the stationary annular retaining ring, a top plate coupled to the binding plate and to the snowboard binding, and a locking element, vertically displaceable to engagingly lock the top plate to the base plate in one of a plurality of rotational positions.

In another advantageous embodiment a method of adjusting a rotational position of a snowboard boot while in a snowboard binding is provided comprising the steps of, positioning a snowboard binding interface between a snowboard and the snowboard binding, vertically displacing a locking mechanism on the snowboard binding interface to disengage the locking mechanism, and rotating the snowboard boot to one of a plurality of rotational positions. The method further comprises the steps of, aligning the locking mechanism with one of a plurality of locking holes provided in a base portion of the snowboard binding interface with an alignment device provided in the snowboard binding interface, and engaging the locking mechanism on a snowboard binding interface to rigidly maintain the selected rotational position of the snowboard boot relative to the snowboard.

In still another advantageous embodiment a snowboard binding interface assembly for mounting between a snowboard binding and a snowboard the interface assembly comprising, a stationary annular retaining ring coupled to the snowboard, the annular retaining ring having an inner circumference ($L_1$). The interface assembly further comprises, a binding plate captured by the stationary annular retaining ring, the binding plate rotationally displaceable to a plurality of rotational positions with respect to the stationary annular retaining ring, the binding plate having an outer circumference ($L_2$), where ($L_2$) is greater than ($L_1$). The interface assembly still further comprises, a top plate coupled between the binding plate and the snowboard binding, the top plate have an outer circumference ($L_3$), where ($L_3$) is greater than ($L_2$).

In yet another advantageous embodiment a snowboard binding interface assembly for mounting between a snowboard binding and a snowboard is provided, the interface assembly comprising, a stationary annular retaining ring coupled to the snowboard, the annular retaining ring having an inner chamfered edge having an angle $\alpha$. The interface assembly further comprises, a binding plate captured by the stationary annular retaining ring, the binding plate rotationally displaceable to a plurality of rotational positions with respect to the stationary annular retaining ring, the binding plate having a chamfered outer edge having an angle $\beta$, where the sum of angle $\alpha$ and angle $\beta$ equal 180°.

In still another advantageous embodiment a snowboard binding interface assembly for mounting between a snowboard binding and a snowboard is provided, the interface assembly comprising, a base plate coupled to the snowboard, and a stationary annular retaining ring coupled to the base plate, the annular retaining ring having an inner circumference ($L_1$). The interface assembly further comprises, a binding plate captured by the stationary annular retaining ring, the binding plate rotationally displaceable to a plurality of rotational positions with respect to the stationary annular retaining ring, the binding plate having an outer circumference ($L_2$), where ($L_2$) is greater than ($L_1$).

In yet another advantageous embodiment a snowboard binding interface assembly for mounting between a snowboard binding and a snowboard the interface assembly is provided comprising, a first stationary portion coupled to the snowboard, and a second moveable portion coupled to the snowboard binding, the second moveable portion being captured by the first stationary portion. The interface assembly further comprises, a top plate coupled between the second moveable portion and the snowboard binding, the top plate being rotatable to one of a plurality of rotational positions.

The invention and its particular features and advantages will become more apparent form the following detailed description considered with reference to the accompanying drawings.

DETAILED DESCRIPTION OF THE DRAWINGS

Figure 1:
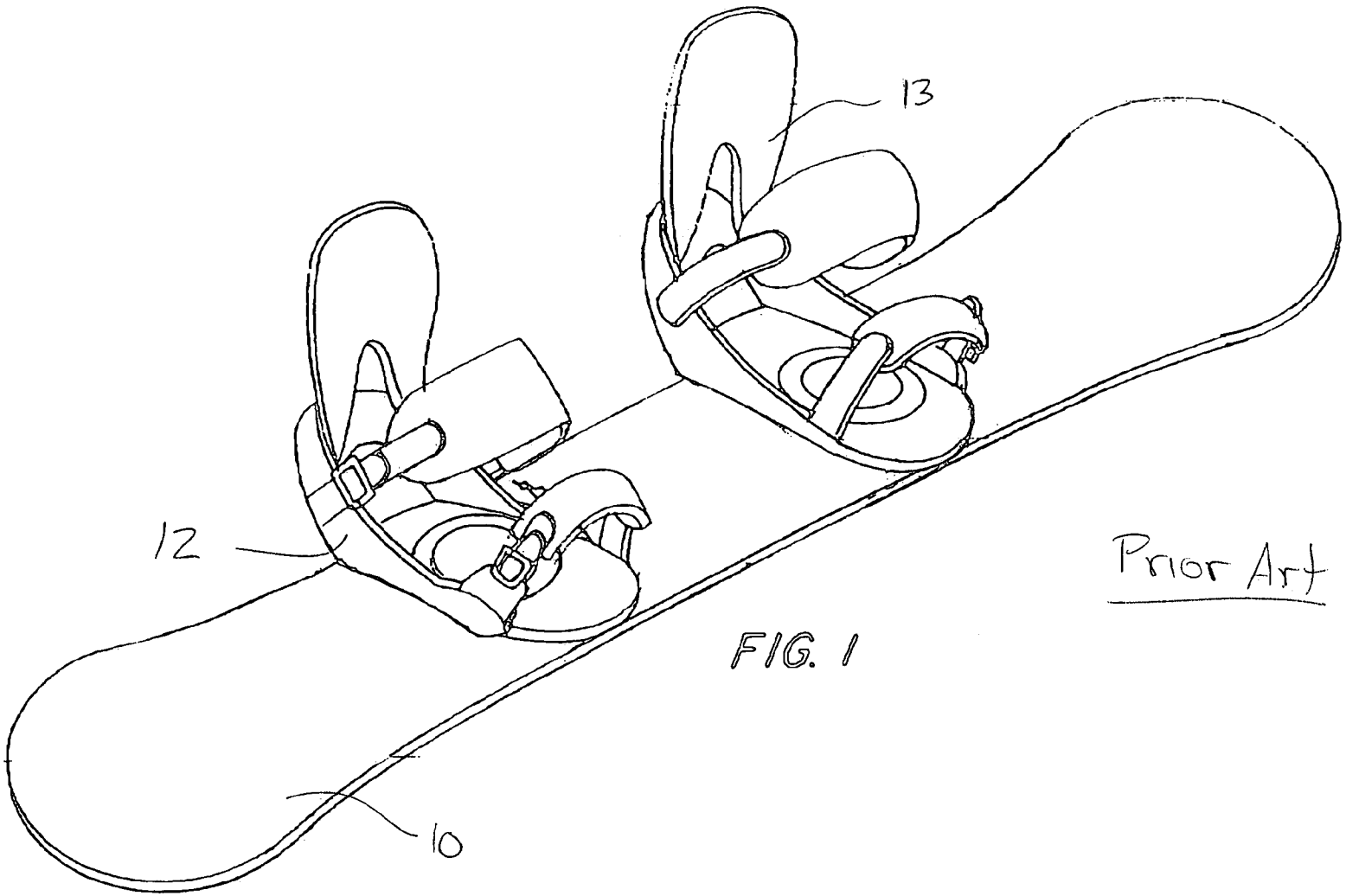
Prior Art FIG. 1
FIG. 1 is illustration of a snowboard and snowboard binding according to the prior art.

Referring now to the drawings, wherein like reference numerals designate corresponding structure throughout the views.

FIG. 1 is an illustration of the prior art illustrating a typical snowboard 10 with a typical snowboard binding 12. The snowboard binding 12 is generally mounted perpendicular to or at an angle close to perpendicular relative to the longitudinal axis of snowboard 10 with either the right or left foot located in the front depending upon the preference of the rider.

The snowboard binding 12 is designed to accept a snowboard boot (not shown in FIG. 1) and is provided with fastening means, typically bolts, which rigidly attach the snowboard bindings 12 to the snowboard 10. When initially installing the snowboard bindings 12 to snowboard 10 the installer may adjust snowboard bindings 12 to a fixed angle relative to the longitudinal axis of snowboard 10 based upon a rider's preference. The angle of rotation however is set and is not adjustable without the proper tools to loosen or remove the snowboard bindings 12 from snowboard 10.

Figure 2:
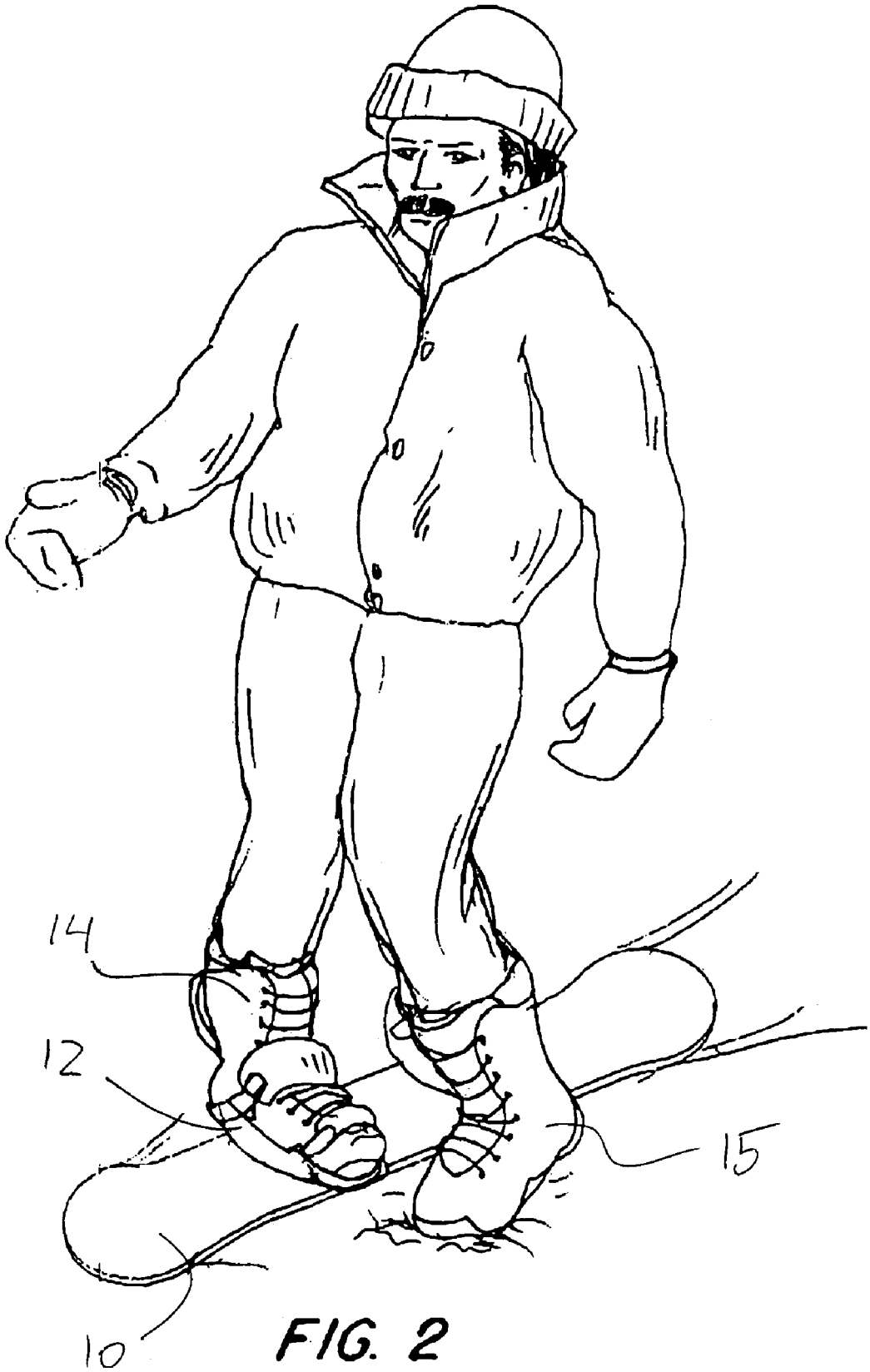
FIG. 2 is an illustration of the "pigeon toe" walk problem caused by the assembly shown in FIG. 1.

As the snowboard binding 12 is not rotationally adjustable without special tools, many riders have to deal with the "pigeon toe" walk illustrated in FIG. 2. The rear snowboard boot 15 shown in FIG. 2 is removed from the rear snowboard boot binding 13 shown in FIG. 1 to propel the rider on a flat surface, however, the forward snowboard boot 14 is still rigidly maintained at the selected rotational angle thereby putting stress on the rider's knee and leg.

Figure 3:
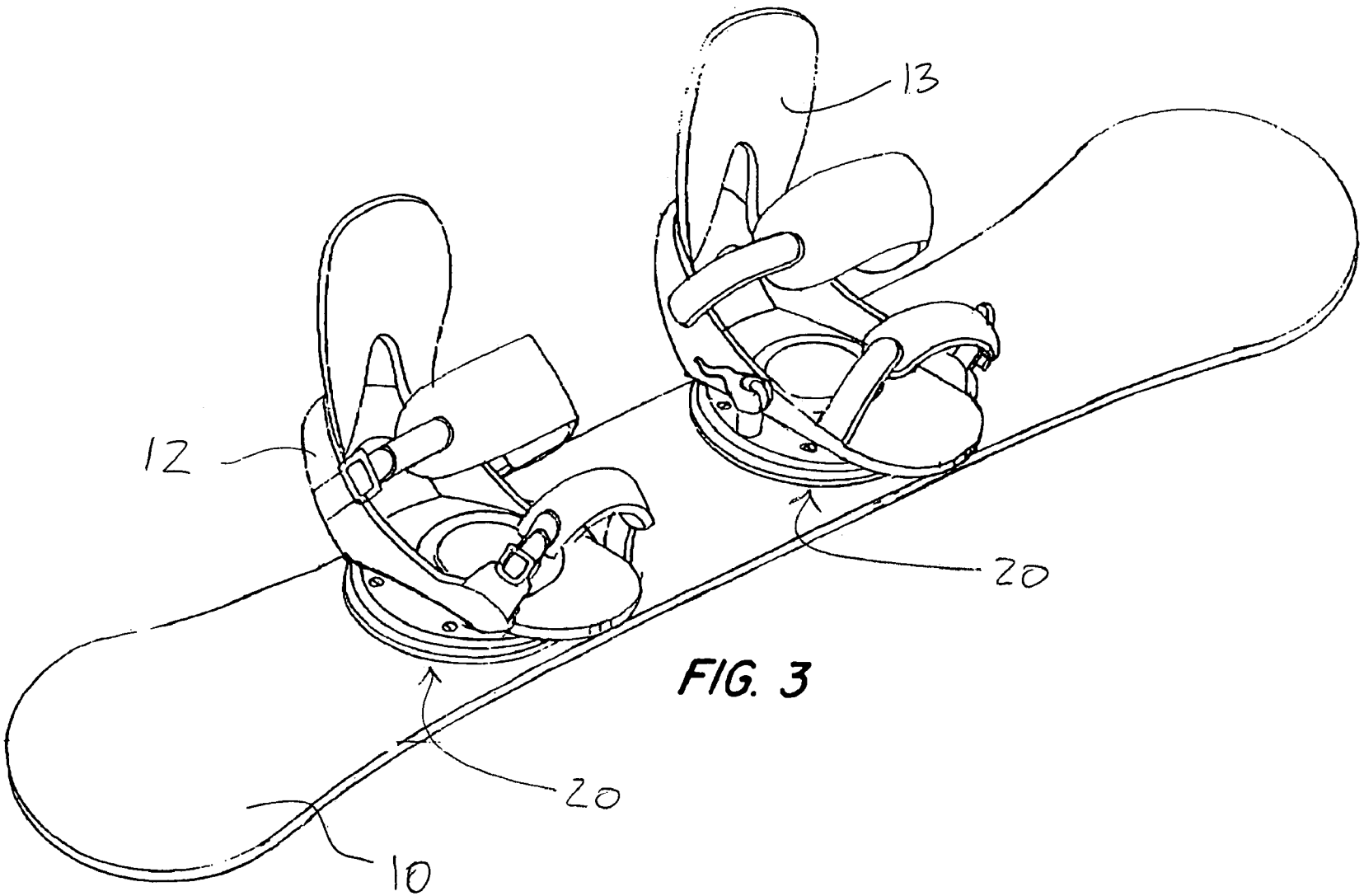
FIG. 3 is an illustration of one advantageous embodiment of the present invention showing a snowboard binding interface assembly located between the snowboard and the snowboard binding.

One advantageous embodiment of the present invention is illustrated in FIG. 3. In this illustration, snowboard binding 12 is affixed to snowboard binding interface assembly 20, which in turn is affixed to snowboard 10. Snowboard binding interface assembly 20 is provided as an interface device adaptable for many differing snowboard binding 12 configurations such that it may easily be used to either retrofit with existing snowboard bindings 12 or with virtually any commercially available snowboard binding 12 currently available. Snowboard binding interface assembly 20 in one advantageous embodiment comprises a hard plastic material such as for instance, a polyethylene or a polypropylene molded material.

In this advantageous embodiment depicted in FIG. 3, snowboard binding interface assembly 20 is shown as a generally circular series of disks that may be rigidly attached to snowboard 10 having the same hole configuration at many existing snowboard bindings 12.

Figure 4A:
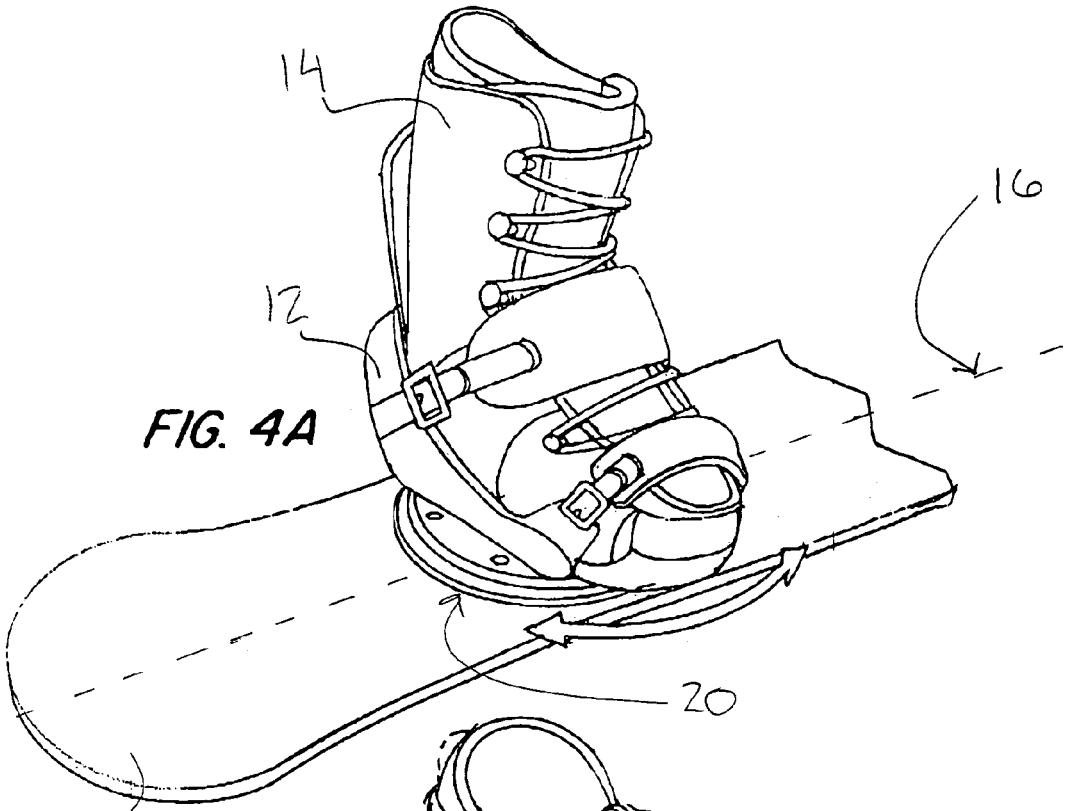
FIG. 4A is an illustration of the snowboard binding interface according to FIG. 3 illustrating the rotational adjustability of the snowboard binding interface assembly.
Figure 4B:
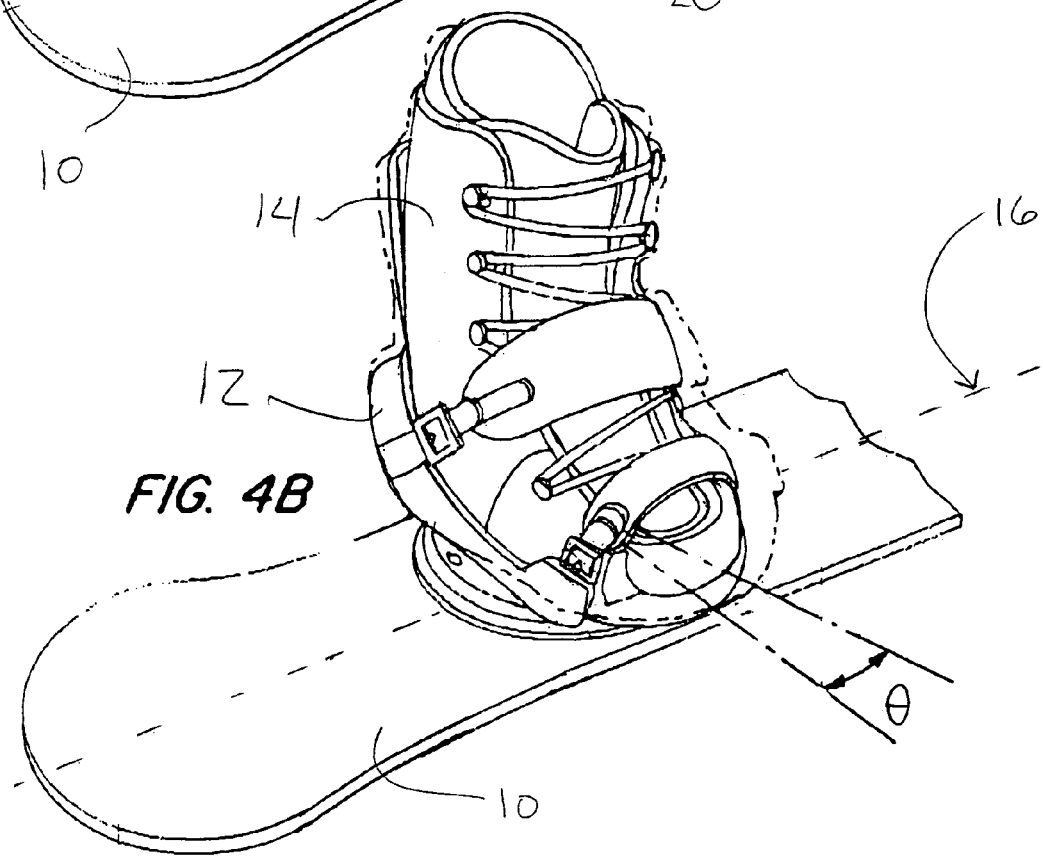
FIG. 4B is an illustration of the snowboard binding interface according to FIG. 3 showing the rotational adjustability of the snowboard binding interface assembly.
Figure 4C:
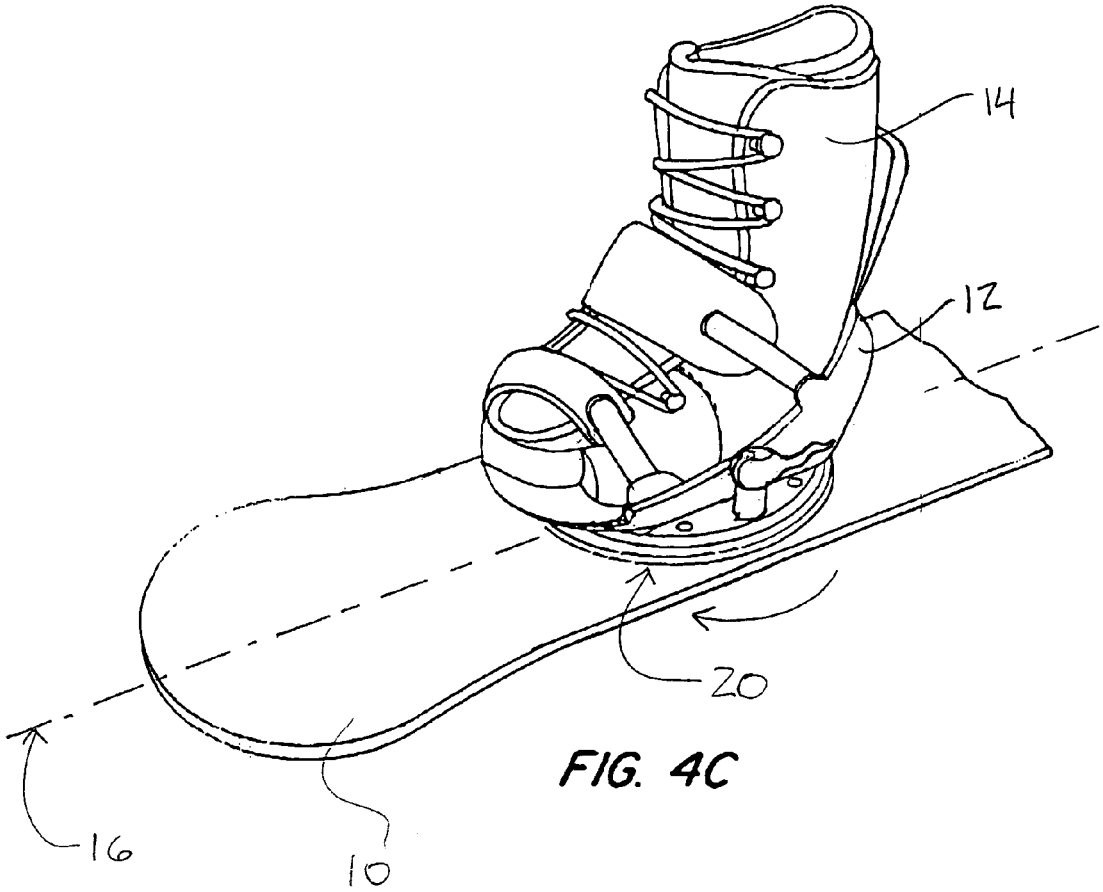
FIG. 4C is an illustration of the snowboard binding interface according to FIG. 3 showing the rotational adjustability of the snowboard binding interface assembly.

Referring to FIGS. 4A-4C, the rotational ability of snowboard binding interface assembly 20 is illustrated. FIG. 4A illustrates snowboard binding interface assembly 20 with snowboard binding 12 in a rotational position essentially perpendicular to the longitudinal axis 16 of snowboard 10. An arrow having two arrow heads facing in opposite rotational directions illustrates that snowboard binding interface assembly 20 is capable of rotation in either direction as desired.

FIG. 4B illustrates the rotational ability of snowboard binding interface assembly 20 where the rider rotates his snowboard boot 14 relative to the longitudinal axis 16. The degree of rotation is illustrated by angle $\theta$. While angle $\theta$ is illustrated as a relatively small rotation forward, the snowboard boot 14 could also have been rotated in the opposite direction toward the back end of snowboard 10 or to a larger angle. In fact, as will be discussed herein, there are a plurality of rotational angles the rider may select as desired.

FIG. 4C illustrates the continued rotation of snowboard binding 12 to an angular position that is essentially inline or parallel to longitudinal axis 16 of snowboard 10. Snowboard binding interface assembly 20 allows the rider to adjust the rotational position of snowboard binding 12 to any of a plurality of rotational positions. In one advantageous embodiment for instance, the rotational angle may be selected in 5 degree intervals such that many rotational angles may be selected by the rider as desired.

It should be noted that while the snowboard binding interface assembly 20 is illustrated rotating from an essentially perpendicular position relative to longitudinal axis 16 to a forward rotational position, snowboard binding interface assembly 20 is capable of 360 degree rotation. In this manner the rider is able to adjust the snowboard bindings 12 to virtually any desired angular position including being able to rotate the snowboard bindings 180 degrees to change for instance, the downhill foot orientation.

Figure 5:
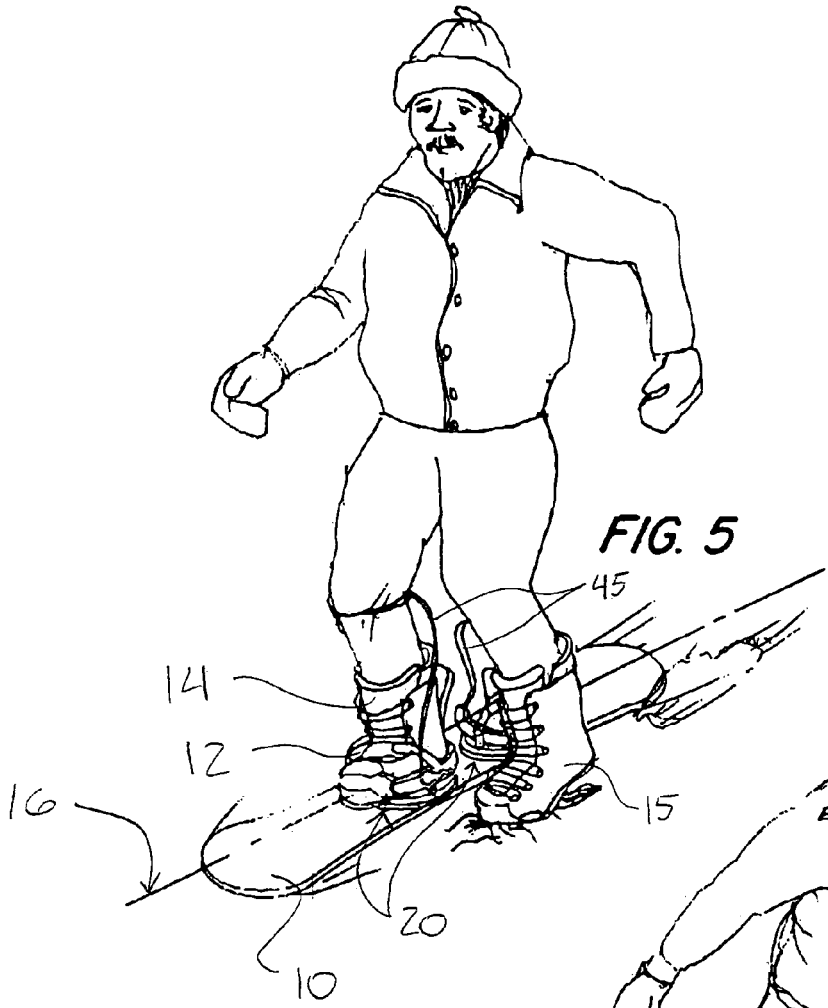
FIG. 5 is an illustration of the snowboard binding interface according to FIG. 3 showing the snowboard binding rotated essentially inline with the longitudinal axis of the snowboard thereby eliminating the "pigeon toe" walk problem.

Referring now to FIG. 5, one can readily see that adjusting the rotational angle of snowboard binding 12 such that it is essentially inline with or parallel to longitudinal axis 16 of snowboard 10, will eliminate the "pigeon toe" walk as previously discussed. It may also be noted that the rider is not obligated to rotate his forward snowboard boot 12 completely inline with longitudinal axis 16 of snowboard 10, but may prefer to rotate it an angular position that lessens the "pigeon toe" walk but still provides lateral balance for the rider. Still another problem addressed with this arrangement is that the ability to rotate snowboard binding 12 to one of a plurality of rotational positions will effectively limit the toe and/or heel drag problem previously discussed. This is because the rider can rotate the toe and/or heel of snowboard boot 14 as desired thereby minimizing any overhang of snowboard boot 14 that may exist. Snowboard binding interface assembly 20 also acts as a spacer, increasing the height of the snowboard boot 14 from the surface of the snow. For instance, in one advantageous embodiment, snowboard binding interface assembly 20 may comprise a ¾ inch lift, which will have a tendency to lift the snow board boot higher off the snow and minimize toe and/or heel drag. This helps to eliminate toe and/or heel drag as the rider may now lean farther over off center without the toe and/or heel of his snowboard boot 14 dragging in the snow. While a ¾ inch lift is disclosed, it is contemplated that a number of differing lift heights may effectively be utilized depending upon the individual and the application.

Figure 6:
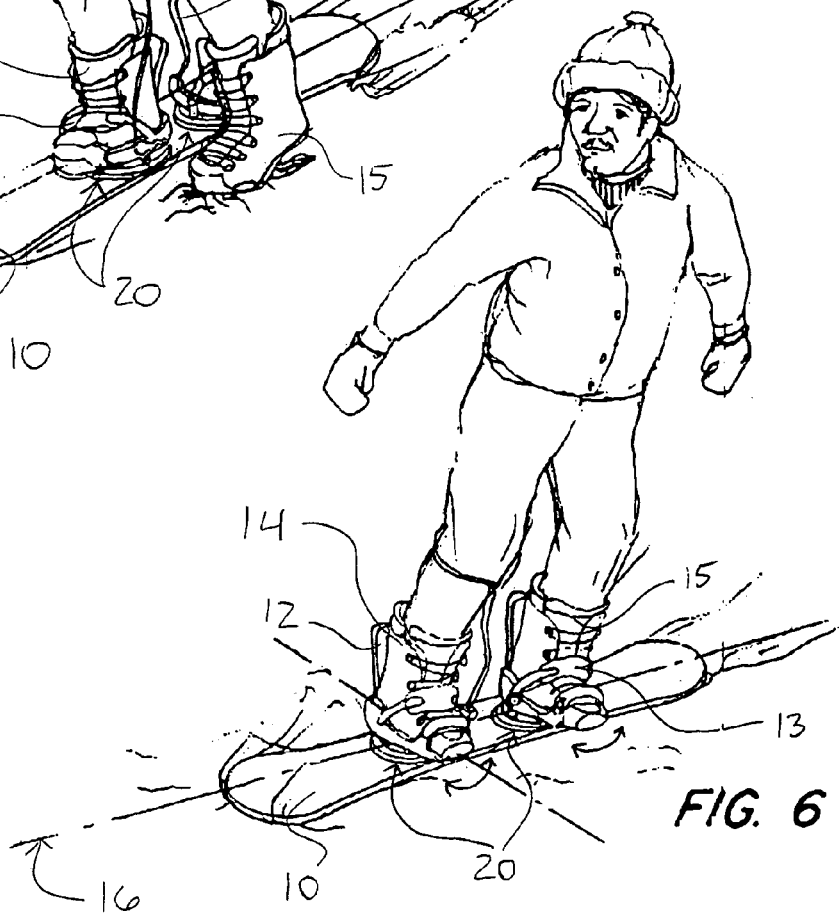
FIG. 6 is an illustration of another advantageous embodiment of the present invention illustrating both snowboard bindings being rotatably adjustable.

FIG. 6 illustrates the full rotational ability of both snowboard boots 14 in snowboard bindings 12. While it is desirable to rotate the front snowboard boot 14 as previous discussed, the rider also has the ability to fully adjust the rear snowboard boot 14 to practically any an angular position as desired. This may be very advantageous as the rider may want to adjust the angular rotation of both the front and rear snowboard boots 14 depending upon the conditions, terrain (i.e. moguls, groomed, deep snow, etc.) and type of activity he is engaging in (i.e. jumping, racing, etc.).

Figure 7:
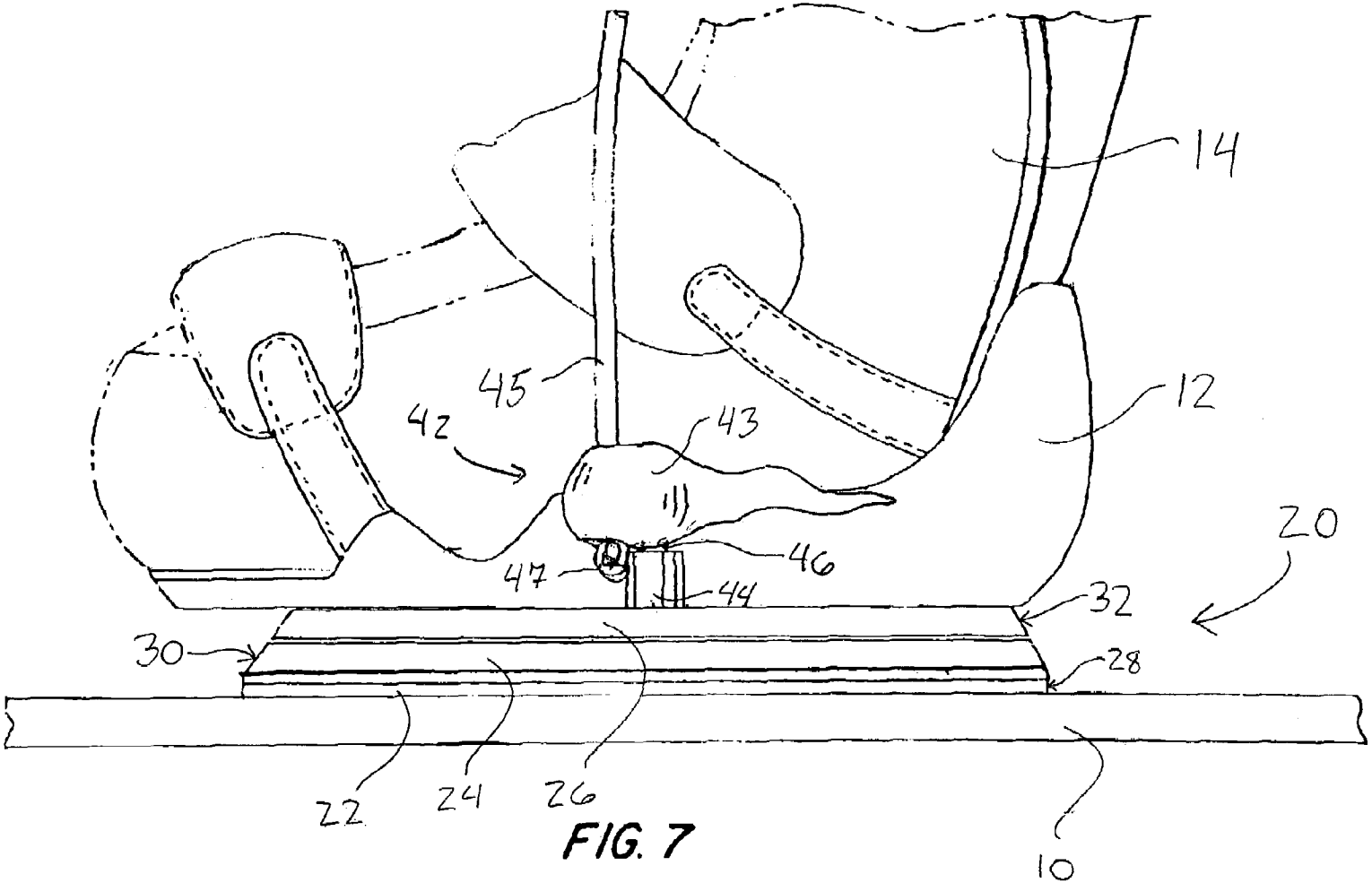
FIG. 7 is a side view of one advantageous embodiment of the present invention showing snowboard binding interface with an attached snowboard and snowboard boot.

FIG. 7 is a side perspective view of another advantageous embodiment of the present invention illustrating snowboard 10, snowboard binding interface assembly 20, snowboard binding 12 and snowboard boot 14.

In this advantageous embodiment snowboard binding interface assembly 20 is illustrated with a base plate 22, an outer ring 24, and a top plate 26. Base plate 22 is rigidly affixed to snowboard 10, while top plate 26 and outer ring 24 are rigidly coupled to snowboard binding 12 such that top plate 26 and outer ring 24 are rotatable relative to base plate 22.

Base plate 22 is further illustrated as a disk having a constant diameter 28, while outer ring 24 is illustrated having a partially beveled outer edge 30. Top plate 26 is illustrated having a fully beveled outer edge 32 such that top plate 26 is essentially frusto-conical in shape. Also shown attached to top plate 26 is locking element 42. Locking element 42 is shown having a housing 44, a locking pin 46, and a pin connector 43. Attached to pin connector 43 is a leash 45 having a knot 47 at an end to maintain leash 45 in pin connector 43. Referring back to FIGS. 5 and 6, it can be seen that leash 45 is connected at the other end to the rider's leg. Locking pin 46 is vertically displaceable such that once locking pin 46 is lifted upward, snowboard binding interface assembly 20 may then be rotated as desired. It should be noted that, since locking element 42 is connected to leash 45, it is a simple matter for the rider to disengage locking element 42 to adjust the angular rotation of snowboard binding interface assembly 20.

Figure 8:
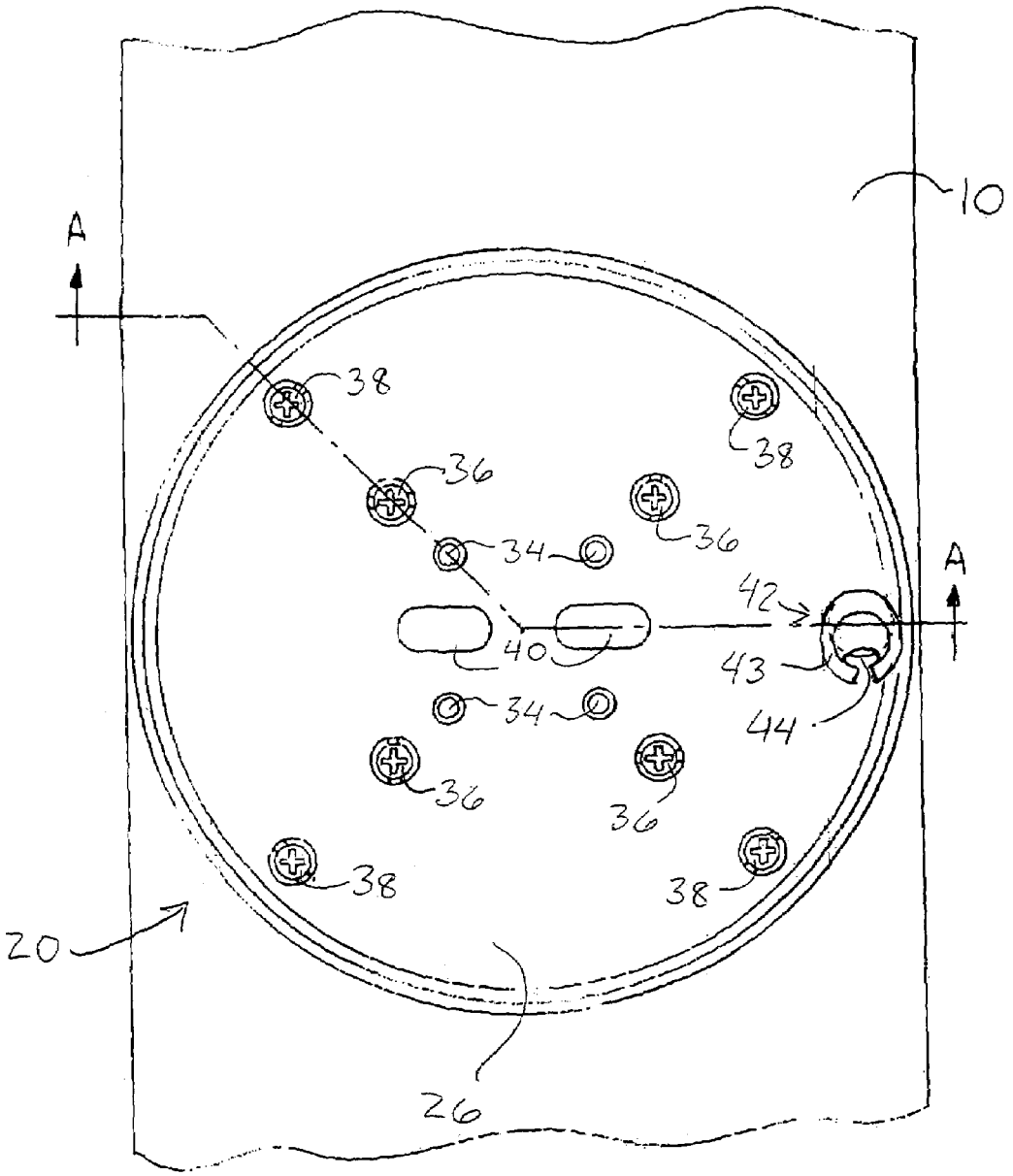
FIG. 8 is a plan view of another advantageous embodiment of the present invention illustrating the snowboard binding interface.

FIG. 8 is a top perspective view of snowboard binding interface assembly 20 without snowboard binding 12 attached thereto. Fully beveled edge 32 shown in FIGS. 8 and 8A can be seen from this view as well as partially beveled edge 30 also shown in FIGS. 8 and 8A. Snowboard binding mounting holes 34 are provided in top plate 26 for rigidly coupling snowboard binding 12 to top plate 26. Snowboard binding mounting holes 34 are spaced and located to interface with numerous differing snowboard bindings 12 mounting holes. Also provided in top plate 26 are binding plate fasteners 36 provided in binding plate fastener holes 37, which are provided to rigidly affix top plate 26 to binding plate 50 (not shown in FIG. 5). Still further provided in top plate 26 are outer ring fasteners 38 provided in outer ring fastener holes 39, which are also provided to rigidly affix top plate 26 to outer ring 24. The means used to affix top plate 26 to outer ring 24 and binding plate 50 may comprise any suitable securing device such as for instance, mounting bolts.

Also provided in top plate 26 are access recesses 40, which are generally illustrated as elongated slots, however it is contemplated that any desired shape may be effectively utilized. Still further provided in top plate 26 is locking element 42 that in this advantageous embodiment, comprises housing 44, a locking pin 46, and a pin connector 43. As previously described, locking pin 46 may be vertically displaceable within housing 44 to place locking element 42 in either an engaged or a disengaged position upon the application of the vertical force.

Figure 8A:
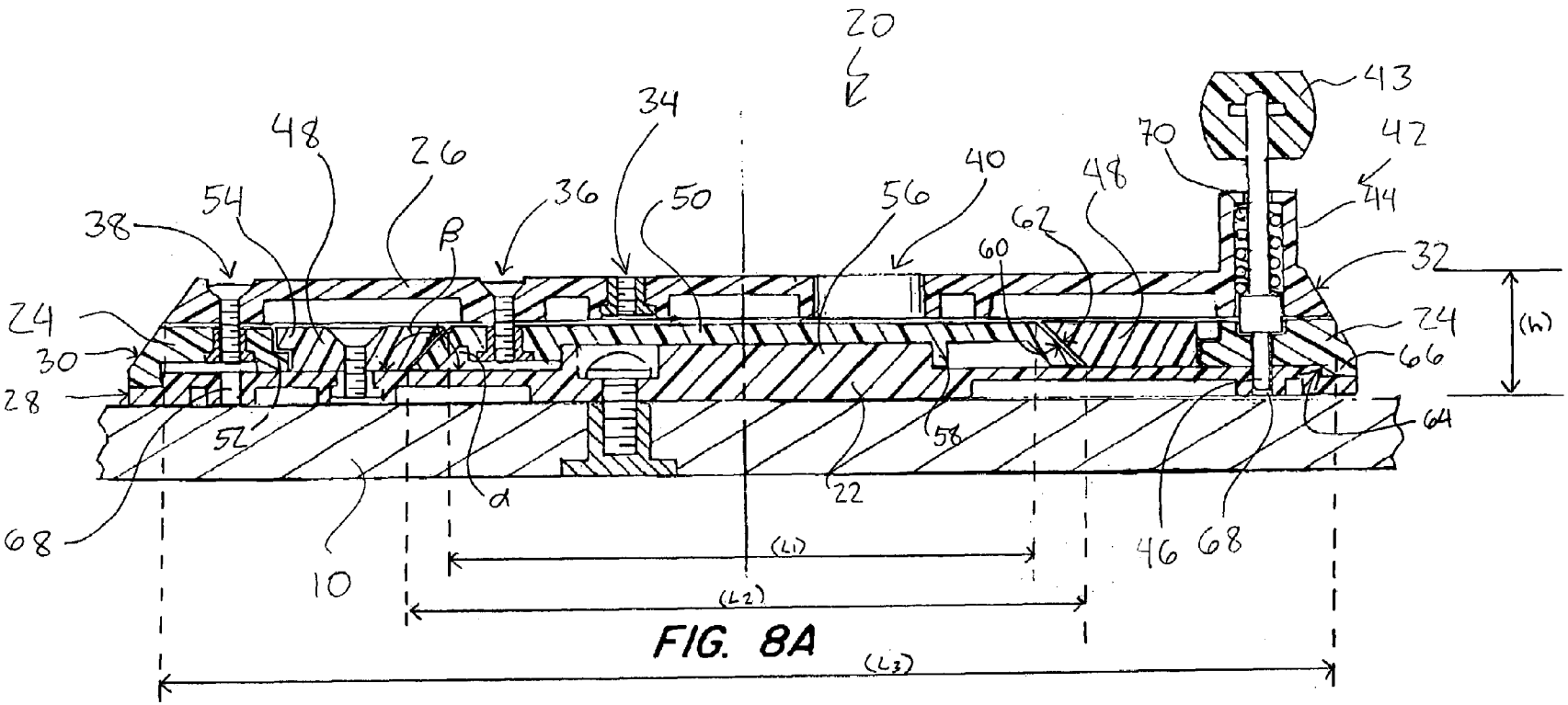
FIG. 8A is a sectional view along section line "A" of the snowboard binding interface according to FIG. 8.

FIG. 8A is a cross-sectional view according to FIG. 8 along section line "A." At the bottom portion of snowboard binding interface assembly 20 base plate 22 is illustrated rigidly attached to snowboard 10. Base plate 22 is provided with a raised inner portion 56 that interacts with a keyed portion 58 of binding plate 50 to center base plate 22. Base plate 22 is also provided with a ridge 64 that coacts with a protrusion 66 provided on outer ring 24 to keep outer ring 24 centered with respect to base plate 22.

Further illustrated in FIG. 8A is binding plate 50 having a beveled outer edge 60 with an angle $\alpha$ relative to the surface of snowboard 10. Beveled outer edge 60 is designed to coact with beveled inner edge 62 of stationary annular retaining ring 48, which comprises an angle $\beta$. Angles $\alpha$ and $\beta$ are selected such that their sum is equal to 180 degrees. In this manner, while stationary annular retaining ring 48 is rigidly attached to snowboard 10 via base plate 22, binding plate 50 is captured in stationary annular retaining ring 48 but is still freely rotatable relative to stationary annular retaining ring 48. Stationary annular retaining ring 48 is still further provided with a lip 54 that is designed to interact with a protrusion 52 located on outer ring 24 such that outer ring 24 is captured by base plate 22 when stationary annular retaining ring 48 is coupled to base plate 22.

Still further illustrated is locking element 42 with housing 44 extending upward from top plate 26. Locking element 42 is shown in the engaged or locked position with locking pin 46 extending into a recess 68 located in base plate 22. Once locking pin 46 engages with recess 68, top plate 26 is held rigidly held in place. Spring 70 is further provided inside housing 44 to bias locking pin 46 toward recess 60. Locking element 42 may be disengaged by application of an upward force to locking pin 46 such that locking pin 46 no longer engages with recess 68. In this manner top plate 26 will be free to rotate relative to base plate 22.

Fully beveled outer edge 32 and partially beveled outer edge 30 are provided to reduce the profile of snowboard binding interface assembly 20 and to provide a surface in which snow, ice and water will not accumulate on or will run off of.

Figure 9:
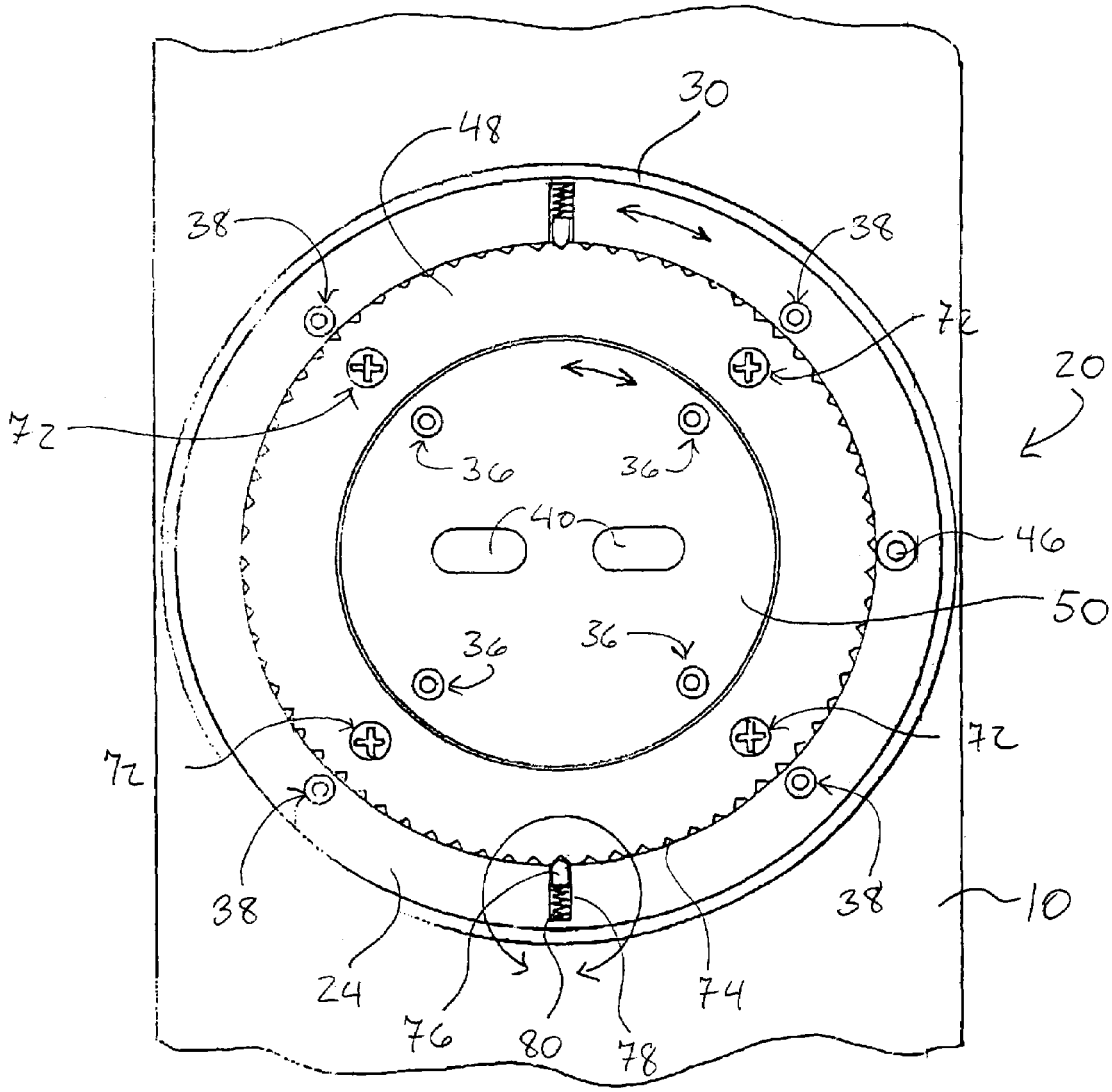
FIG. 9 is a plan view of the snowboard binding interface with the top plate removed according to FIG. 8.

FIG. 9 is a plan view of snowboard binding interface assembly 20 with top plate 26 removed. It can be seen that binding plate 50 is located at the center, with stationary annular retaining ring 48 located in and around binding plate 50 and finally outer ring 24 situated around stationary annular retaining ring 48. As previously described, stationary annular retaining ring 48 is rigidly coupled to base plate 22 by means of stationary annular retaining ring fasteners 72, which may comprise for instance, mounting bolts and are inserted in stationary annular retaining ring fastener holes 73. Binding plate 50 and outer ring 24 are both rotatable, as illustrated by the arrows, relative to stationary annular retaining ring 48.

Stationary annular retaining ring 48 is provided with a keyed outer edge 74 designed to interact with alignment pin 76. Alignment pin 76 is located in alignment pin recess 78 located in outer ring 24 and is provided to assist the rider in aligning locking pin 46 with one of the plurality of recesses 68 provided in base plate 22. Also provided in alignment pin recess 78 is alignment pin spring 80, provided to bias alignment pin 76 toward keyed outer edge 74.

While two alignment pins 76 are illustrated 180 degrees apart from each other in FIG. 9, it is contemplated that only one alignment pin 76 may be utilized or alternatively, any number may be used as desired.

Figure 10:
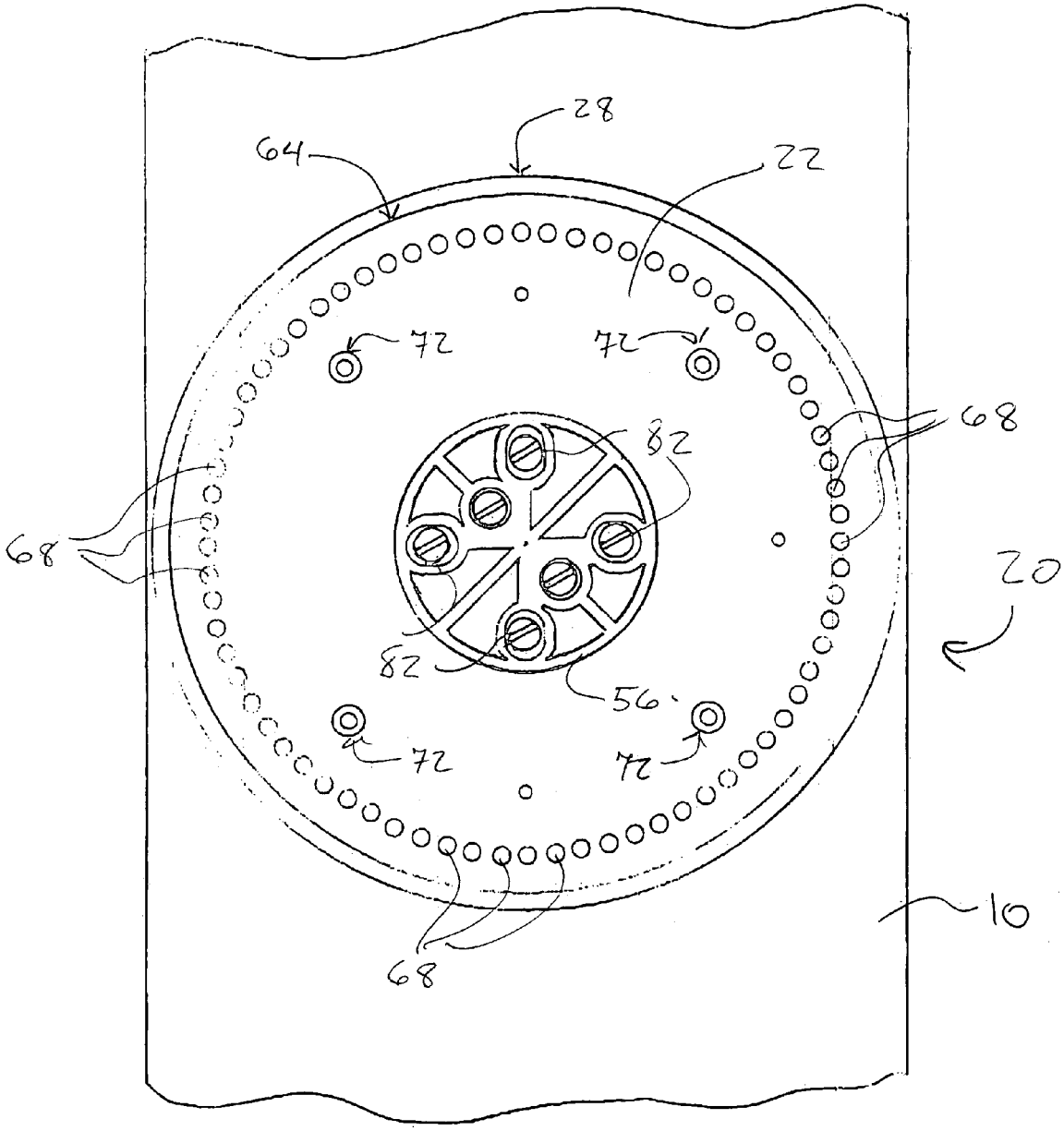
FIG. 10 is a plan view of the snowboard binding interface illustrating the base plate according to FIG. 8.

FIG. 10 is a further plan view of snowboard binding interface assembly 20 illustrating base plate 22. As can readily be seen, a plurality of recesses 68 is distributed about the circumference of base plate 22. In this particular embodiment, the recesses 68 are distributed approximately 5 degrees apart thereby providing many differing angular positions available for the rider to position his snowboard boots 14. Stationary annular retaining ring holes 84 located in base plate 22 are provided for receiving stationary annular retaining ring fasteners 72 for rigidly attaching stationary annular retaining ring 48 to base plate 22. Also illustrated on base plate 22 are base plate fasteners 82, which have a similar layout as snowboard binding mounting holes 34. In this manner snowboard binding interface assembly 20 may easily be retrofitted with an existing snowboard/snowboard binding assembly.

Figure 11:
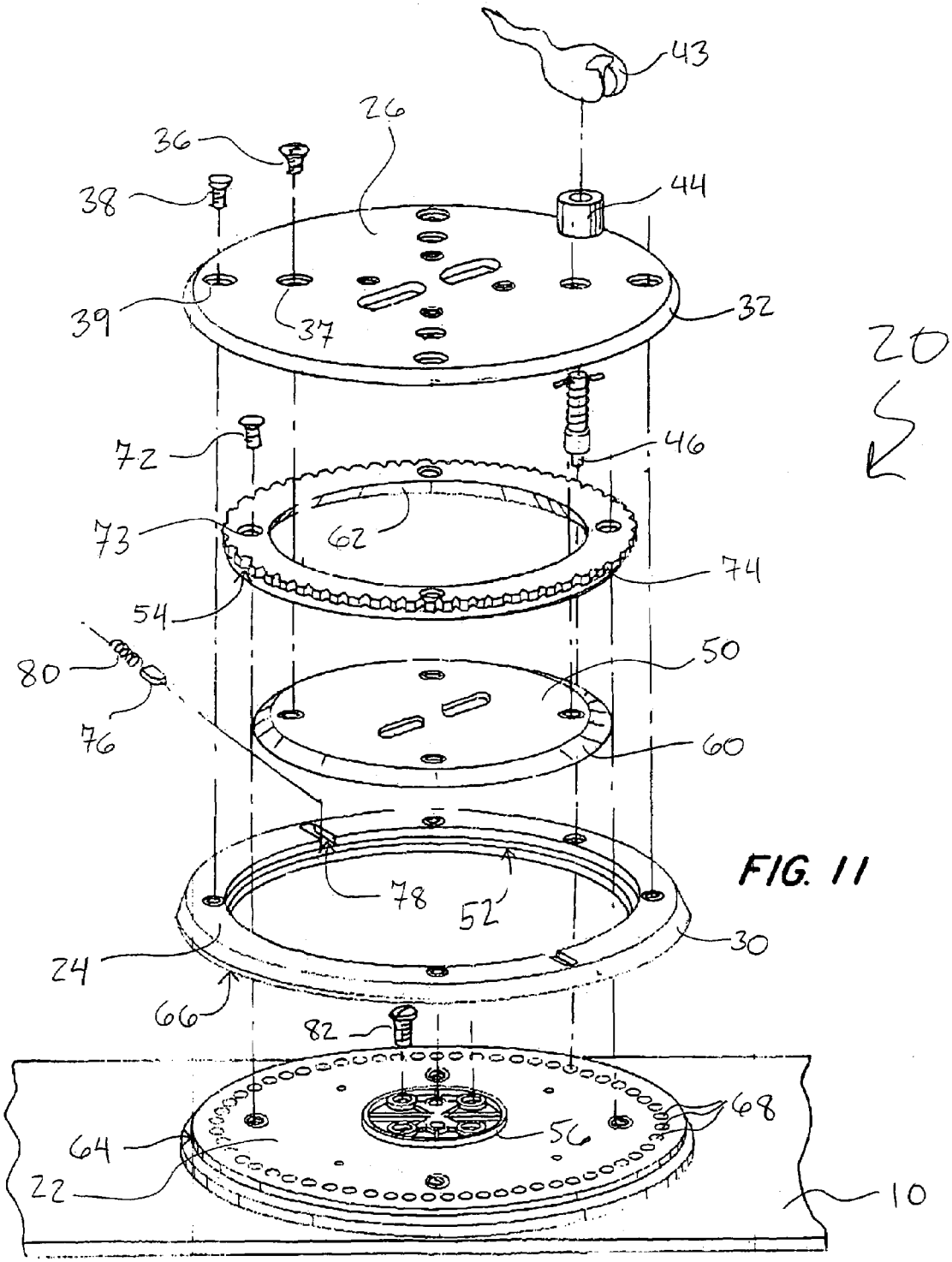
FIG. 11 is an exploded assembly drawing illustrating still another advantageous embodiment of the present invention showing the snowboard binding interface.

FIG. 11 is an exploded assembly drawing of one advantageous embodiment of the present invention. Snowboard binding interface assembly 20 is variously illustrated in the manner in which it may be assembled with base plate 22 being mounted to snowboard 10 via base plate fasteners 82. Outer ring 24 may next be inserted over base plate 22 in such a manner that ridge 64 on base plate 22 coacts with a protrusion 66 located on outer ring 24 to center outer ring 24 with respect to base plate 22. Binding plate 50 may then be inserted on base plate 22 such that raised inner portion 56 of base plate 22 interacts with a keyed portion 58 of binding plate 50 to center binding plate 50 with respect to base plate 22. Stationary annular retaining ring 48 may then be inserted on and attached to base plate 22 by means of stationary annular retaining ring fasteners 72. Stationary annular retaining ring 48 captures both binding plate 50 and outer ring 24 such that they cannot be removed unless stationary annular retaining ring 48 is first removed from base plate 22. Finally, top plate 26 may be attached to both binding plate 50 by means of binding plate fasteners 36 and outer ring 24 by means of outer ring fasteners 38.

Locking pin 44 extends through top plate 26, outer ring 24 and into one of the plurality of recesses 68 located in base plate 22. In this manner, top plate 26 may rotate relative to base plate 22 when locking pin 46 is disengaged from one of the plurality of recesses 68 as previously described herein. It is contemplated that locking element 42 may further be keyed such that it may not be disengaged from one of the plurality of recesses 68 unless locking pin 46 is first rotated thereby allowing locking pin 46 to be withdrawn from recess 68.

Once assembled it is contemplated that snowboard binding interface assembly 20 may comprise approximately one inch in height above the surface of snowboard 10. In this manner, snowboard binding interface assembly 20 also effectively acts as a spacer between snowboard 10 and snowboard binding 12.

Figure 12:
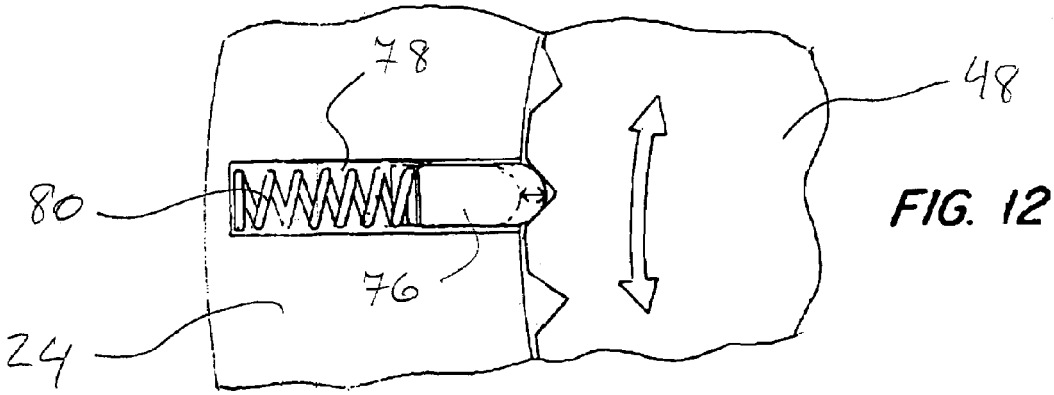
FIG. 12 is an enlarged plan view of a portion of FIG. 9.

FIG. 12 is a larger plan view of the keyed outer edge 74 of stationary annular retaining ring 48 and the interaction with alignment pin 76 provided in alignment pin recess 78 located in outer ring 24. As can be seen, alignment pin 76 is biased toward keyed outer edge 74 by alignment pin spring 80. While keyed outer edge 74 is illustrated with a sawtooth cut, it is contemplated that any suitable keying may effectively be utilized that corresponds to each recess 68 located in base plate 22.

Figure 13:
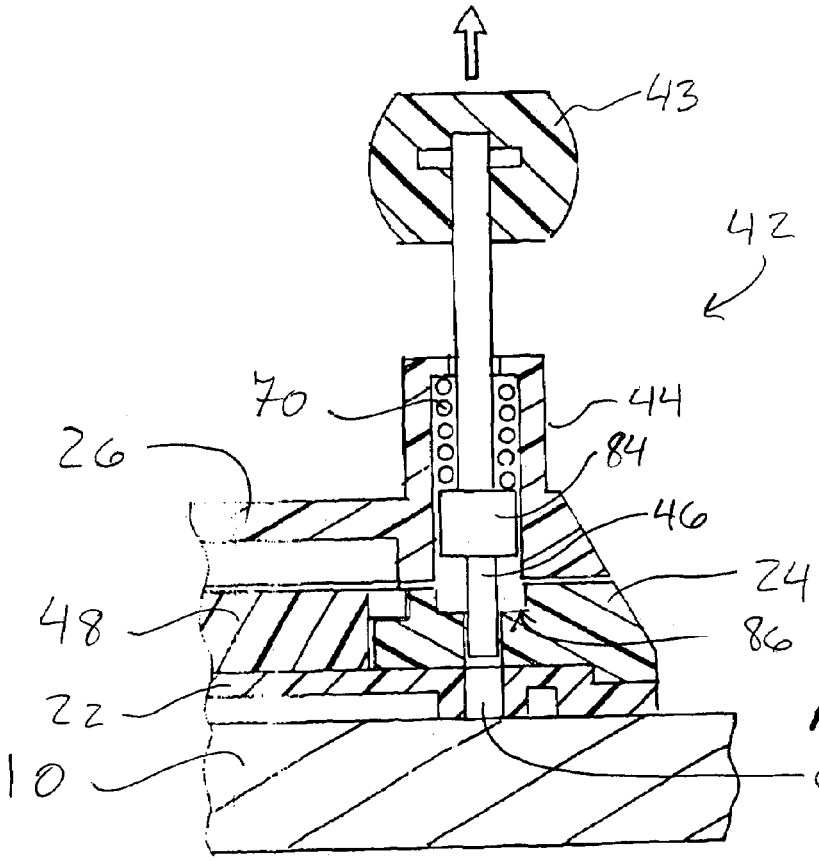
FIG. 13 is an enlarged sectional view of a portion of FIG. 8A.

FIG. 13 is an enlarged sectional view according to FIG. 8A of locking element 42 illustrating locking pin 46 in a disengaged position. It can further be seen that locking pin 46 is provided with an enlarged cross-section portion 84 designed to interact with shoulder 86 to prevent locking pin 46 from extending too far into recess 68.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A snowboard binding interface assembly for mounting a snowboard binding to a snowboard, the interface assembly comprising:

a base plate coupled to the snowboard and having a plurality of recesses for receiving a locking device;

a stationary annular retaining ring rigidly coupled to said base plate;

a binding plate captured by said stationary annular retaining ring, said binding plate rotationally displaceable with respect to said stationary annular retaining ring;

a top plate coupled to said binding plate and to the snowboard binding;

a locking element, displaceable to engagingly lock said top plate to said base plate in one of a plurality of rotational positions, said locking element including a locking pin extending through the top plate, the locking pin engaging with one of a plurality of locking holes located in the base plate; and an alignment device for aligning the locking pin with one of the plurality of locking holes when selecting one of the plurality of rotational positions, said alignment device providing an indication to a user when the locking pin is substantially aligned with one of the plurality of locking holes;

wherein the stationary annular retaining ring has a lip that engages with an outer edge of the binding plate.

2. The snowboard binding interface assembly according to claim 1 wherein the binding plate comprises a disk.

3. The snowboard binding interface assembly according to claim 1 wherein the lip comprises a chamfered edge having an angle $\alpha$ and the binding plate has a chamfered outer edge having an angle $\beta$, where the sum of angle $\alpha$ and angle $\beta$ equal 180°.

4. The snowboard binding interface assembly according to claim 1 wherein the locking pin is biased to an engaged position with one of the plurality of locking holes.

5. The snowboard binding interface assembly according to claim 1 wherein the locking holes are distributed around a circumference of the base plate.

6. The snowboard binding interface assembly according to claim 1 wherein the locking holes are angularly distributed around the base plate at no less than approximately five degree intervals.

7. The snowboard binding interface assembly according to claim 1 wherein the locking pin is connected to one end of a leash which is provided to connect to a rider's leg.

8. The snowboard binding interface assembly according to claim 1 wherein the locking pin is keyed to maintain the locking pin in a locked position with one of the plurality of locking holes.

9. A method of adjusting a rotational position of a snowboard boot while in a snowboard binding comprising the steps of:

positioning a snowboard binding interface between a snowboard and the snowboard binding;

vertically displacing a locking mechanism on the snowboard binding interface to disengage the locking mechanism;

rotating the snowboard boot to one of a plurality of rotational positions;

aligning the locking mechanism with one of a plurality of locking holes provided in a base portion of the snowboard binding interface with an alignment device provided in the snowboard binding interface, the alignment device providing an indication to a user when the locking mechanism is substantially aligned with one of the plurality of locking holes while the locking mechanism is disengaged, the alignment device providing a biasing alignment force such that the alignment of the locking mechanism with one of the plurality of locking holes is maintained prior to engaging the locking mechanism; and engaging the locking mechanism on a snowboard binding interface to rigidly maintain the selected rotational position of the snowboard boot relative to the snowboard.

10. The method according to claim 9 wherein the plurality of rotational positions are no less than approximately five degree rotational adjustments.

11. The method according to claim 9 wherein the locking mechanism is biased to a locked position.

12. The method according to claim 9 wherein the locking mechanism is connected to one end of a leash which is provided to connect to a rider's leg.

13. The method according to claim 12 wherein the step of vertically displacing the locking mechanism is accomplished by pulling upward on the leash that is connected to the locking mechanism.

14. A snowboard binding interface assembly for mounting between a snowboard binding and a snowboard, the interface assembly comprising:

a stationary annular retaining ring coupled to the snowboard, said annular retaining ring having an inner circumference ($L_1$);

a binding plate captured by said stationary annular retaining ring, said binding plate rotationally displaceable to a plurality of rotational positions with respect to said stationary annular retaining ring, said binding plate having an outer circumference ($L_2$), where ($L_2$) is greater than ($L_1$);

a top plate coupled between said binding plate and the snowboard binding, said top plate have an outer circumference ($L_3$), where ($L_3$) is greater than ($L_2$);

a locking element to lock said binding plate in one of the plurality of rotational positions;

an alignment device for aligning the locking element with one of the plurality of rotational positions; and a base plate coupled between the snowboard and said stationary annular retaining ring, said base plate having a plurality of recesses for receiving the locking element;

an outer ring located between said top plate and said base plate, said outer ring coupled to the top plate.

15. The snowboard binding interface assembly according to claim 14 wherein the stationary annular retaining ring is provided with a keyed outer edge and the alignment device comprises an alignment pin located in the outer ring, the alignment pin engaging with the keyed outer edge to selectively align the locking pin with one of the plurality of recesses.

16. The snowboard binding interface assembly according to claim 14 the locking element is vertically displaceable to engagingly lock said top plate to said base plate in one of the plurality of rotational positions.

17. The snowboard binding interface assembly according to claim 14 wherein said locking element comprises a locking pin located in said top plate that engages with one of the plurality of recesses.

18. The snowboard binding interface assembly according to claim 17 wherein the locking pin is selectively biased to an engaged position with one of the plurality of recesses.

19. A snowboard binding interface assembly for mounting between a snowboard binding and a snowboard the interface assembly comprising:

a stationary annular retaining ring coupled to the snowboard, said annular retaining ring having an inner circumference ($L_1$);

a binding plate captured by said stationary annular retaining ring, said binding plate rotationally displaceable to a plurality of rotational positions with respect to said stationary annular retaining ring, said binding plate having an outer circumference ($L_2$), where ($L_2$) is greater than ($L_1$), said binding plate having an outer circumference ($L_3$); and an outer ring captured by said stationary annular retaining ring, said outer ring having an inner circumference ($L_4$), where ($L_3$) is greater than ($L_4$).

wherein the stationary annular retaining ring has a lip that engages with an outer edge of the binding plate.

20. The snowboard binding interface according to claim 19 further comprising a locking mechanism to hold said binding plate at one of the plurality of rotational positions.

21. The snowboard binding interface assembly according to claim 20 further comprising an alignment device for aligning the locking element with one of the plurality of rotational positions.

22. A snowboard binding interface assembly for mounting between a snowboard binding and a snowboard the interface assembly comprising:

a base plate coupled to the snowboard;

a stationary annular retaining ring coupled to said base plate, said annular retaining ring having an inner circumference ($L_1$), said annular retaining ring having a continuous inner wall; and a binding plate captured by said stationary annular retaining ring, said binding plate rotationally displaceable to a plurality of rotational positions with respect to said stationary annular retaining ring, said binding plate having continuous outer wall abutting said continuous inner wall and having a circumference ($L_2$), where ($L_2$) is greater than ($L_1$), and said binding plate is maintained fully within said stationary annular retaining ring with no portion thereof extending beyond an outer perimeter of said stationary annular retaining ring;

said base plate having a plurality of recesses positioned on an upper surface thereof and selectively engagable with a vertically displaceable locking element to lock said binding plate in one of the plurality of rotational positions, said plurality of recesses substantially evenly spaced around a perimeter of said base plate.

23. The snowboard binding interface assembly according to claim 22 further comprising an alignment device for aligning the locking element with one of the plurality of rotational positions.

24. A snowboard binding interface assembly for mounting between a snowboard binding and a snowboard the interface assembly comprising:

a stationary annular retaining ring coupled to the snowboard comprising a continuous enclosed ring;

a binding plate coupled to the snowboard binding, said binding plate being captured by said stationary annular retaining ring such that said binding plate is maintained fully within said stationary annular retaining ring with no portion thereof extending beyond an outer perimeter of said stationary annular retaining ring;

a top plate coupled between said binding plate and the snowboard binding, said top plate being rotatable to one of a plurality of rotational positions;

wherein said annular retaining ring has an inner circumference ($L_1$), said binding plate has an outer circumference ($L_2$), where ($L_2$) is greater than ($L_1$), and said top plate has an outer circumference ($L_3$), where ($L_3$) is greater than ($L_2$).

25. The snowboard binding interface assembly according to claim 24 wherein said stationary annular retaining ring has an inner chamfered edge having an angle $\alpha$ and said binding plate has a chamfered outer edge having an angle $\beta$, where the sum of angle $\alpha$ and angle $\beta$ equal 180°.

26. The snowboard binding interface assembly according to claim 24 wherein the snowboard binding interface assembly has a height (h) of approximately ¾ of an inch.

27. The snowboard binding interface assembly according to claim 24 further comprising a locking element to lock said binding plate in one of the plurality of rotational positions.

28. The snowboard binding interface assembly according to claim 27 further comprising an alignment device for aligning the locking element with one of the plurality of rotational positions.

29. A snowboard binding interface assembly for mounting a snowboard binding to a snowboard, the interface assembly comprising:

a base plate coupled to the snowboard and having a plurality of recesses for receiving a locking device;

a stationary annular retaining ring rigidly coupled to said base plate;

a binding plate captured by said stationary annular retaining ring, said binding plate rotationally displaceable with respect to said stationary annular retaining ring;

a top plate coupled to said binding plate and to the snowboard binding;

an outer ring located between said top plate and said base plate, said outer ring coupled to the top plate;

a locking element, displaceable to engagingly lock said top plate to said base plate in one of a plurality of rotational positions, said locking element including a locking pin extending through the top plate, the locking pin engaging with one of a plurality of locking holes located in the base plate; and an alignment device for aligning the locking pin with one of the plurality of locking holes when selecting one of the plurality of rotational positions, said alignment device providing an indication to a user when the locking pin is substantially aligned with one of the plurality of locking holes.

30. A snowboard binding interface assembly for mounting a snowboard binding to a snowboard, the interface assembly comprising:

a base plate coupled to the snowboard and having a plurality of recesses for receiving a locking device;

a stationary annular retaining ring rigidly coupled to said base plate;

a binding plate captured by said stationary annular retaining ring, said binding late rotationally displaceable with respect to said stationary annular retaining ring;

a top plate coupled to said binding plate and to the snowboard binding;

a locking element, displaceable to engagingly lock said top plate to said base plate in one of a plurality of rotational positions, said locking element including a locking pin extending through the top plate, the locking pin engaging with one of a plurality of locking holes located in the base plate; and an alignment device for aligning the locking pin with one of the plurality of locking holes when selecting one of the plurality of rotational positions, said alignment device providing an indication to a user when the locking pin is substantially aligned with one of the plurality of locking holes;

wherein the stationary annular retaining ring is provided with a keyed outer edge and the alignment device comprises an alignment pin located in an outer ring coupled to the top plate, the alignment pin engaging with the keyed outer edge to selectively align the locking pin with one of the plurality of locking holes.

* * * * *